US006332389B1

(12) United States Patent
Han

(10) Patent No.: US 6,332,389 B1
(45) Date of Patent: Dec. 25, 2001

(54) MANUAL DIE SET FOR PRESSING EXPLOSIVE POWDER INTO HARDWARE

(75) Inventor: Philip S. Han, Issue, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/625,846

(22) Filed: Jul. 26, 2000

(51) Int. Cl.[7] ..... F42B 33/10
(52) U.S. Cl. ..... 86/30; 86/23; 86/29; 86/30
(58) Field of Search ..... 89/47, 24; 86/30, 86/29, 36, 23, 43

(56) References Cited

U.S. PATENT DOCUMENTS

| | | | | |
|---|---|---|---|---|
| 2,741,148 | * | 4/1956 | Thompson | 86/30 |
| 3,745,875 | * | 7/1973 | Kennedy | 86/23 |
| 3,823,669 | * | 7/1974 | Zacharin | 102/221 |
| 3,974,736 | * | 8/1976 | Minko | 86/24 |
| 4,537,112 | * | 8/1985 | Dabonde | 86/24 |
| 4,836,078 | * | 6/1989 | Lee | 86/24 |
| 4,862,567 | * | 9/1989 | Beebe | 86/43 |
| 5,649,465 | * | 7/1997 | Beebe | 86/37 |
| 6,244,154 | * | 6/2001 | Beebe et al. | 86/43 |

FOREIGN PATENT DOCUMENTS

2830600 * 1/1980 (DE) ..... 86/23

* cited by examiner

*Primary Examiner*—Michael J. Carone
*Assistant Examiner*—Lulit Semunegus
(74) *Attorney, Agent, or Firm*—Mark Homer

(57) ABSTRACT

A manual die set includes a ram, the ram having an upper portion and a lower portion; a ram head removably connected to the upper portion of the ram; a die, the die defining an opening therethrough for reciprocably receiving the ram, the die including a top portion and a bottom portion, the bottom portion including an upward facing step; a support ring disposed in the die opening in the bottom portion of the die, the support ring defining a bore therethrough; a baseplate disposed in a bottom of the die opening and extending into a bottom of the support ring bore; a die guide plate for supporting the die and the baseplate; and a spring disposed in the die opening, the lower portion of the ram being inserted through a center of the spring, a lower end of the spring bearing against the upward facing step in the bottom portion of the die, an upper end of the spring bearing against a bottom face of the upper portion of the ram; wherein the spring is compressed when a pressing force moves the ram downwardly such that when the pressing force is removed from the ram, the spring forces the ram to move upwardly.

12 Claims, 2 Drawing Sheets

MANUAL DIE SET FOR PRESSING EXPLOSIVE POWDER INTO HARDWARE

STATEMENT OF GOVERNMENT INTEREST

The invention described herein may be manufactured and used by or for the Government of the United States of America for government purposes without the payment of any royalties therefor.

BACKGROUND OF THE INVENTION

The invention relates in general to manual die sets for pressing explosive powder and in particular to manual die sets for pressing explosive powder into hardware.

For some munitions applications, it is desirable to have explosive powder encased in hardware, such as a cup. The cup is a hollow tube with a closed bottom and is made of, for example, aluminum or an aluminum alloy. The explosive powder is a highly sensitive explosive molding powder, for example, PBXN-9 or PBXW-11. The explosive powder is poured into the cup and the cup is inserted into a die. A ram presses the explosive powder in the cup to form a pellet in the cup. The ram is then retracted, and the cup with the explosive pellet therein removed from the die. A set of crimping tools is used to close the top opening in the cup.

A particularly dangerous part of the above-described procedure is retracting the ram from the cup. The inside diameter of the cup is generally about 0.003 to 0.005 inches larger than the outside diameter of the ram. The cup retains explosive powder residue on its internal surfaces. As the ram is retracted, it is possible that friction between the ram and the powder residue on the inside of the cup way cause the powder residue to ignite and explode, and, in turn, cause the pressed powder to ignite and explode. Therefore, it is necessary that any humans be far enough away from the retracting operation to avoid injury or death if the powder explodes.

Although humans possess the strength required to retract the ram from the cup, the danger of explosion absolutely prohibits a human from manually retracting the ram from the cup. Therefore, "fixed" die sets have been used to press explosive powder into hardware, such as a cup. In the fixed die set, the ram is rigidly connected to the pressing device. The pressing device is, for example, a 100 to 200 ton hydraulic press. The press is remotely controlled so that the human operator is out of the zone of danger, should an explosion occur. The fixed die set is safer for the operator, but there are some disadvantages of using a fixed die set.

First, much time is required to manufacture the tooling to fix the ram to a press. Second, because different models of presses may be used, different tooling for each press is necessary. Third, after the ram is attached to the press, the press is "dedicated" to a single operation, until the ram is removed. Fourth, much time is spent aligning the ram that is attached to the press to the die. Last, different lengths of ram travel are necessary for different amounts of explosive powder used. Thus, the fixed die set and/or press must be adjusted whenever a different length of ram travel is desired.

The present invention is a manual die set that overcomes the disadvantages of the fixed die set while maintaining the safety of the human operator.

SUMMARY OF THE INVENTION

The present invention provides a manual die set comprising a ram, the ram having an upper portion and a lower portion; a ram head removably connected to the upper portion of the ram; a die, the die defining an opening therethrough for reciprocably receiving the ram, the die including a top portion and a bottom portion, the bottom portion including an upward facing step; a support ring disposed in the die opening in the bottom portion of the die, the support ring defining a bore therethrough; a baseplate disposed in a bottom of the die opening and extending into a bottom of the support ring bore; a die guide plate for supporting the die and the baseplate; and a spring disposed in the die opening, the lower portion of the ram being inserted through a center of the spring, a lower end of the spring bearing against the upward facing step in the bottom portion of the die, an upper end of the spring bearing against a bottom face of the upper portion of the ram; wherein the spring is compressed when a pressing force moves the ram downwardly such that when the pressing force is removed from the ram, the spring forces the ram to move upwardly.

The manual die set further comprises a cup with explosive molding powder disposed therein, the cup being disposed in the support ring bore between the lower portion of the ram and the baseplate, the cup being supported by the baseplate.

Preferably, the top portion of the die is removably connected to the bottom portion of the die, and the ram head is removably connected to the upper portion of the ram by a cap screw. The upper portion of the ram includes an upward facing step. The top portion of the die includes a downward facing step that limits upward movement of the ram by engaging the upward facing step of the upper portion of the ram. A pressing distance is defined by a distance between a bottom surface of the ram head and a top surface of the die, when the ram is in a fully retracted position.

In one embodiment, the manual die set further comprises a plurality of rams wherein a distance from the upward facing step of the upper portion of the ram to a top surface of the upper portion of the ram varies with each one of the plurality rams whereby the pressing distance is adjustable by changing rams in the manual die set.

Another aspect of the invention is a method of compressing explosive powder in hardware comprising pouring explosive molding powder into a cup; placing the cup in the support ring bore; inserting the baseplate in the support ring bore below the cup; inserting the cup, support ring and baseplate in the bottom of the die opening; placing the die on the die guide plate; moving the ram downwardly to compress the explosive molding powder into a pellet; retracting the ram using the spring; lifting the die off the die guide plate and removing the baseplate; and removing the support ring and cup with the explosive pellet therein, as a unit.

Further objects, features and advantages of the invention will become apparent from the following detailed description taken in conjunction with the following drawing.

BRIEF DESCRIPTION OF THE DRAWING

Throughout the Figures, reference numerals that are the same refer to the same features.

DETAILED DESCRIPTON OF THE PREFERRED EMBODIMENTS

The present invention is a manual die set and process for pressing highly sensitive explosive powder into hardware, such as a cup. Because the ram of the invention is not fixed to a press, there is no need to manufacture tooling for attaching the ram to the press. In addition, there is no need to align a fixed ram and die. Also, the press may be used for other operations by simply removing the manual die set from the press. Another advantage of the present invention is that variations in the amount of explosive powder used, which require different ram travel lengths, may be accommodated by simply substituting one part of the die set.

Figure 2A:
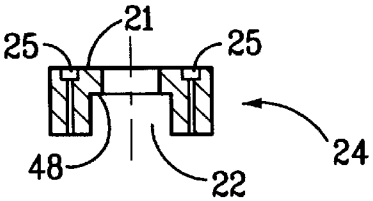
FIG. 2(A) is a reduced cross-sectional elevation view of the top portion of the die.
Figure 2B:
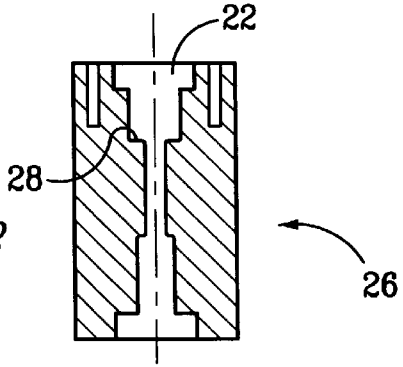
FIG. 2(B) is a reduced cross-sectional elevation view of the bottom portion of the die.
Figure 3:
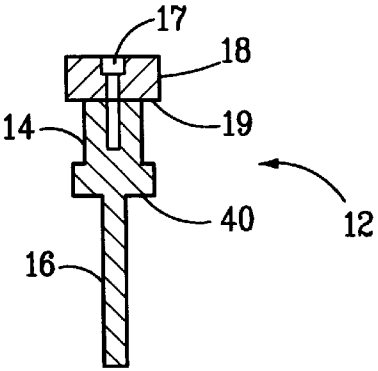
FIG. 3 is a reduced cross-sectional elevation view of the ram and ram head.
Figure 1:
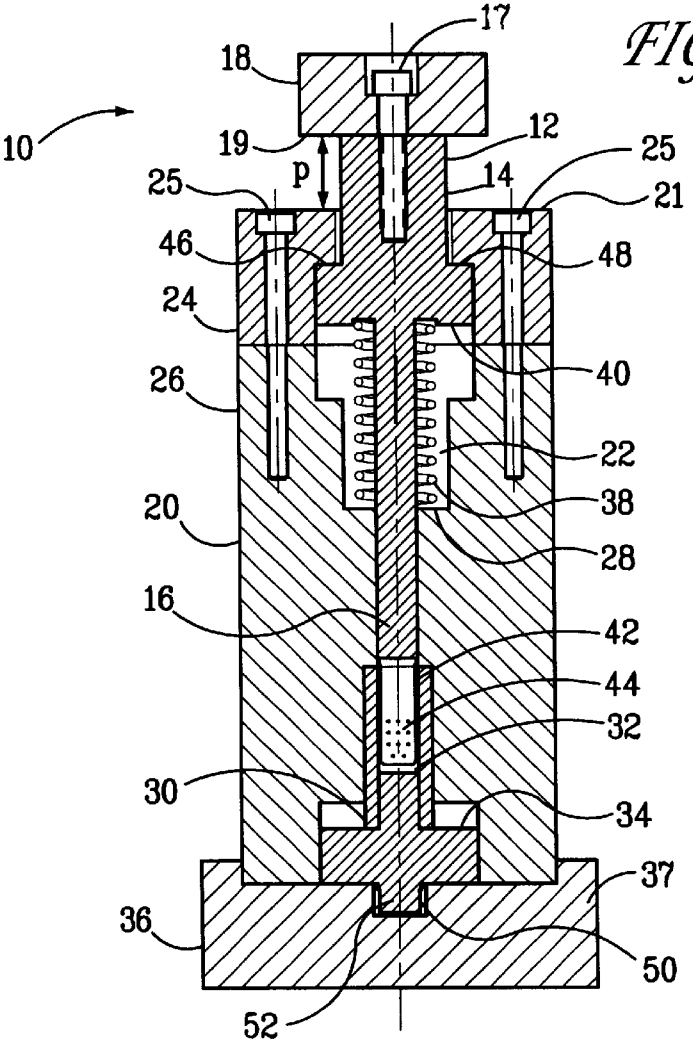
FIG. 1 is a cross-sectional elevation view of one embodiment of a manual die set according to the invention.

FIG. 1 is a cross-sectional elevation view of one embodiment of a manual die set 10 according to the invention. FIG. 2(A) is a reduced cross-sectional elevation view of the top portion 24 of the die 20. FIG. 2(B) is a reduced cross-sectional elevation view of the bottom portion 26 of the die 20. FIG. 3 is a reduced cross-sectional elevation view of the ram 12 and ram head 18.

Manual die set 10 includes a ram 12 having an upper portion 14 and a lower portion 16. A ram head 18 is removably connected to the upper portion 14 of the ram by, for example, a cap screw 17. A die 20 defines an opening 22 therethrough for reciprocably receiving the ram 12. Die 20 includes a top portion 24 and a bottom portion 26. The top portion 24 of the die 20 is removably connected to the bottom portion 26 of the die 20 by, for example, cap screws 25. The bottom portion 26 of the die 20 includes an upward facing step 28.

Figure 6:
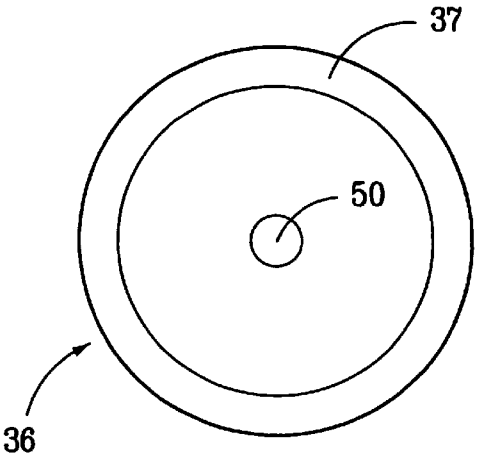
FIG. 6 is a top view of the die guide plate.
Figure 4:
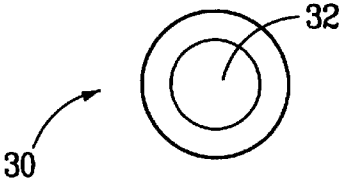
FIG. 4 is a top view of the support ring.
Figure 5A:
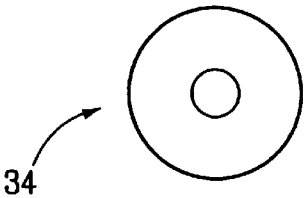
FIG. 5(A) is a top view of the baseplate.
Figure 5B:
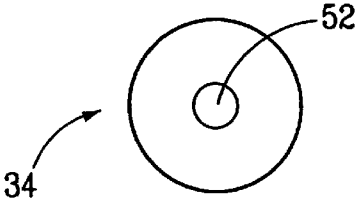
FIG. 5(B) is a bottom view of the baseplate.

A support ring 30 is disposed in the die opening 22 in the bottom portion 26 of the die 20. The support ring 30 defines a bore 32 therethrough. FIG. 4 is a top view of the support ring 30. A baseplate 34 is disposed in a bottom of the die opening 22 and extends into a bottom of the support ring bore 32. A die guide plate 36 supports the die 20 and the baseplate 34. FIG. 5(A) is a top view of the baseplate 34. FIG. 5(B) is a bottom view of the baseplate 34. FIG. 6 is a top view of the die guide plate 36. The ram 12, ram head 18, die 20, support ring 30, baseplate 34 and die guide plate 36 are all made of hardened tool steel.

A spring 38 made of, for example, steel or a steel alloy, is disposed in the die opening 22. The lower portion 16 of the ram 12 is inserted through a center of the spring 38. A lower end of the spring 38 bears against the upward facing step 28 in the bottom portion 26 of the die 20. An upper end of the spring 38 bears against a bottom face 40 of the upper portion 14 of the ram 12. Spring 38 is compressed when a pressing force moves the ram 12 downwardly such that when the pressing force is removed from the ram 12, the spring 38 forces the ram 12 to move upwardly to its retracted position.

Spring 38 is compressed even when the ram 12 is fully retracted. The free length of spring 38 is about 0.25 inches longer than its length when the ram 12 is fully retracted. The spring constant of spring 38 is, for example, 300 pounds/inch. The pressing force is applied to ram head 18 by, for example, a conventional hydraulic press in the 100 to 200 ton range. The force applied is in the range of about 15 kpsi to 30 kpsi.

A cup 42 has explosive molding powder 44 disposed therein. The cup 42 is disposed in the support ring bore 32 between the lower portion 16 of the ram 12 and the baseplate 34. The cup 42 is supported by the baseplate 34.

The upper portion 14 of the ram 12 includes an upward facing step 46. The top portion 24 of the die 20 includes a downward facing step 48 that limits upward movement of the ram 12 by engaging the upward facing step 46 of the upper portion 14 of the ram 12. A pressing distance P is defined by a distance between a bottom surface 19 of the ram head 18 and a top surface 21 of the die 20, when the ram 12 is in a fully retracted position, as in FIG. 1.

Figure 7A:
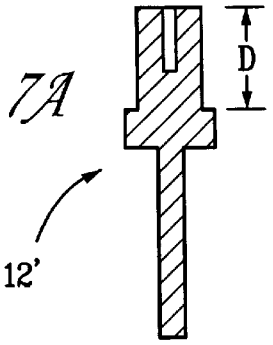
FIGS. 7(A) and 7(B) are cross-sectional elevation views of interchangeable rams.
Figure 7B:
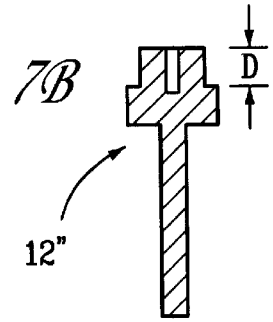

The manual die set 10 further includes a plurality of interchangeable rams. FIGS. 7(A) and 7(B) are cross-sectional elevation views of interchangeable rams 12' and 12". A distance D from the upward facing step of the upper portion of each ram 12', 12" to a top surface of the upper portion of each ram varies from ram to ram so that the pressing distance P is adjustable by changing rams in the manual die set 10. Although two rams 12', 12" are shown, it should be understood that additional rams having varying distances D may be used in the manual die set 10. The rams are changed by removing ram head 18 from ram 12. Cap screws 25 are removed and the top portion 24 of the die 20 is lifted off of bottom portion 26. Ram 12 is then lifted out of die opening 22 and a different ram is inserted through spring 38 in die opening 22. The top portion 24 of die 20 is replaced and ram head 18 is attached to the new ram.

The die guide plate 36 includes a circumferential shoulder 37 on a top surface thereof. The bottom of die 20 is disposed within the confines of circumferential shoulder 37. The die guide plate 36 also includes a circular opening 50 in a center of the top surface. The baseplate 34 includes a cylindrical extension 52 on a bottom surface thereof. The baseplate cylindrical extension 52 is disposed in the circular opening 50 of the die guide plate 36 for alignment purposes.

The manual die set 10 operates in the following manner. The cup 42 is filled with the desired amount of explosive molding powder 44, for example, PBXN-9 or PBXW-11. Cup 42 is placed in support ring bore 32 and baseplate 34 is inserted below cup 42. Cup 42, support ring 30 and baseplate 34 are inserted in the bottom of die opening 22. Die 20 is placed on die guide plate 36 and baseplate cylindrical extension 52 is inserted in circular opening 50 in the die guide plate 36. The manual die set 10 is then placed in a conventional press (not shown). The press may be operated remotely from a safe distance through a conventional remote control.

The press applies force to the ram head 18, which forces the ram 12 downwardly to compress the explosive powder 44 into a pellet in cup 42. After a required dwell time, the pressing force is released from the ram head 18. The spring 38 then forces the ram 12 upward to its retracted position. Die 20 is lifted off die guide plate 36 and baseplate 34 is removed. Support ring 30 and cup 42 with the explosive pellet therein are removed as a unit. Support ring 30 and cup 42 are then inserted into a known crimping device to close the top opening in cup 42. The procedure is then repeated.

Different sizes of manual die set 10 may be used, depending on the diameter of cup 42. Some exemplary dimensions of one preferred embodiment are as follows (all dimensions are in inches): cup 42 inside diameter, 0.380; cup 42 outside diameter, 0.475; support ring 30 inside diameter, 0.4075; support ring 30 outside diameter, 0.6500; support ring 30 vertical height, 1.510; die opening 22 inside diameter at support ring location, 0.6510; die opening 22 inside diameter at lower portion 16 of ram 12, 0.3760; lower portion 16 of ram 12 outside diameter, 0.3740; outside diameter of bottom face of ram 12, 1.480; outside diameter of upper portion 14 of ram 12, 1.000; inside diameter of circular opening in die guide plate, 0.500.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A manual die set, comprising:

a ram, the ram having an upper portion and a lower portion;

a ram head removably connected to the upper portion of the ram;

a die, the die defining an opening therethrough for reciprocably receiving the ram, the die including a top portion and a bottom portion, the bottom portion including an upward facing step;

a support ring disposed in the die opening in the bottom portion of the die, the support ring defining a bore therethrough;

a baseplate disposed in a bottom of the die opening and extending into a bottom of the support ring bore;

a die guide plate for supporting the die and the baseplate; and a spring disposed in the die opening, the lower portion of the ram being inserted through a center of the spring, a lower end of the spring bearing against the upward facing step in the bottom portion of the die, an upper end of the spring bearing against a bottom face of the upper portion of the ram;

wherein the spring is compressed when a pressing force moves the ram downwardly such that when the pressing force is removed from the ram, the spring forces the ram to move upwardly.

2. The manual die set of claim 1, further comprising a cup with explosive molding powder disposed therein, the cup being disposed in the support ring bore between the lower portion of the ram and the baseplate, the cup being supported by the baseplate.

3. The manual die set of claim 2, wherein the top portion of the die is removably connected to the bottom portion of the die.

4. The manual die set of claim 3, wherein the ram head is removably connected to the upper portion of the ram by a cap screw.

5. The manual die set of claim 4, wherein the upper portion of the ram includes an upward facing step.

6. The manual die set of claim 5, wherein the top portion of the die includes a downward facing step that limits upward movement of the ram by engaging the upward facing step of the upper portion of the ram.

7. The manual die set of claim 6, wherein a pressing distance is defined by a distance between a bottom surface of the ram head and a top surface of the die, when the ram is in a fully retracted position.

8. The manual die set of claim 7, further comprising a plurality of rams wherein a distance from the upward facing step of the upper portion of the ram to a top surface of the upper portion of the ram varies with each one of the plurality rams whereby the pressing distance is adjustable by changing rams in the manual die set.

9. The manual die set of claim 8, wherein the die guide plate includes a circumferential shoulder on a top surface thereof.

10. The manual die set of claim 9, wherein the die guide plate includes a circular opening in a center of the top surface.

11. The manual die set of claim 10, wherein the baseplate includes a cylindrical extension on a bottom surface thereof, the cylindrical extension being disposed in the circular opening of the die guide plate.

12. A method of compressing explosive powder in hardware using the apparatus of claim 1, comprising:

pouring explosive molding powder into a cup;

placing the cup in the support ring bore;

inserting the baseplate in the support ring bore below the cup;

inserting the cup, support ring and baseplate in the bottom of the die opening;

placing the die on the die guide plate;

moving the ram downwardly to compress the explosive molding powder into a pellet;

retracting the ram using the spring;

lifting the die off the die guide plate and removing the baseplate; and removing the support ring and cup with the explosive pellet therein, as a unit.

* * * * *

UNITED STATES PATENT AND TRADEMARK OFFICE

CERTIFICATE OF CORRECTION

PATENT NO. : 6,332,389 B1
DATED : December 25, 2001
INVENTOR(S) : Phillip S. Han It is certified that error appears in the above-identified patent and that said Letters Patent is hereby corrected as shown below:

Title page,
Item [75], inventor's name should read -- Phillip S. Han --.

Signed and Sealed this

Thirtieth Day of April, 2002

*Attest:*

*Attesting Officer*

JAMES E. ROGAN
*Director of the United States Patent and Trademark Office*